US011265630B2

(12) United States Patent
Qiu et al.

(10) Patent No.: US 11,265,630 B2
(45) Date of Patent: Mar. 1, 2022

(54) LAYERED SPEAKER DIAPHRAGM WITH A FIRST PERFORATED LAYER

(71) Applicant: AAC Technologies Pte. Ltd., Singapore (SG)

(72) Inventors: Zhiqiang Qiu, Shenzhen (CN); Shasha Liu, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 0 days.

(21) Appl. No.: 16/993,262

(22) Filed: Aug. 14, 2020

(65) Prior Publication Data

US 2020/0413172 A1 Dec. 31, 2020

Related U.S. Application Data

(63) Continuation of application No. PCT/CN2019/094015, filed on Jun. 29, 2019.

(51) Int. Cl.
*H04R 1/02* (2006.01)

(52) U.S. Cl.
CPC ..... *H04R 1/02* (2013.01)

(58) Field of Classification Search
CPC ..... H04R 1/02; H04R 2307/025; H04R 2307/027; H04R 7/26; H04R 7/125; H04R 7/10; H04R 31/003; H04R 9/06; H04R 2400/11
See application file for complete search history.

(56) References Cited

U.S. PATENT DOCUMENTS 6,097,829 A * 8/2000 Guenther ..... H04R 7/06 381/425
6,931,140 B2 * 8/2005 Van Halteren ..... H04R 9/063 181/173
8,891,810 B2 * 11/2014 Reckert ..... H04R 7/02 381/423

FOREIGN PATENT DOCUMENTS

JP 59165597 A * 9/1984 ..... H04R 7/10

* cited by examiner

*Primary Examiner* — Brian Ensey
(74) *Attorney, Agent, or Firm* — W&G Law Group

(57) ABSTRACT

A speaker includes a frame, a vibration unit fixed to the frame, and a magnetic circuit unit fixed to the frame. The vibration unit includes a diaphragm fixed to the frame, and a coil configured to drive the diaphragm to vibrate and sound. The diaphragm includes a dome. The dome includes a first layer, a second layer and a third layer which are stacked sequentially in a direction from the coil to the diaphragm. The second layer includes a honeycomb structure. The third layer includes a body and a plurality of through holes extending through the body in a vibration direction of the diaphragm. The through holes communicate with the honey structure of the second layer form a resonance cavity.

9 Claims, 4 Drawing Sheets

LAYERED SPEAKER DIAPHRAGM WITH A FIRST PERFORATED LAYER

FIELD OF THE INVENTION

The present disclosure relates to the field of speakers, and in particular to an speaker for screen sounding.

BACKGROUND

With the advent of the mobile internet era, the number of smart mobile devices has been continuously increasing. Among various mobile devices, mobile phones are undoubtedly the most common and most portable mobile devices. Currently, the functions of mobile phones are very diverse, and one of them is the high-quality music function. Thus, speakers used to play sounds are applied to current smart mobile phones in large quantities.

A speaker of the related art comprises a frame, and a vibration unit and a magnetic circuit unit fixed to the frame. The vibration unit comprises a diaphragm fixed to the frame and a coil configured to drive the diaphragm to vibrate and sound. The diaphragm comprises a dome.

However, in the speaker of the related art, there exists apparent front cavity resonance. In the vicinity of high-frequency resonance, the energy of the sound wave is too high, and sound distortion and noise are usually amplified apparently.

Therefore, it is desired to provide an improved speaker which can overcome at least one of the above problems.

SUMMARY

Accordingly, the present disclosure is directed to a speaker which can effectively absorb sound energy in the front cavity.

The present disclosure provides a speaker which comprises a frame, a vibration unit fixed to the frame and a magnetic circuit unit fixed to the frame. The vibration unit comprises a diaphragm fixed to the frame, and a coil configured to drive the diaphragm to vibrate and sound. The diaphragm comprises a dome which comprises a first layer, a second layer and a third layer stacked sequentially in a direction from the coil to the diaphragm. The second layer comprises a honeycomb structure. The third layer comprises a body and a plurality of through holes extending through the body in a vibration direction of the diaphragm. The through holes communicate with the honeycomb structure of the second layer to form a resonance cavity.

In some embodiment, the diaphragm further comprises a vibration part connected to the dome, a suspension part extending outwardly from the vibration part and a mounting part extending outwardly from the suspension part, the dome being fixed to the vibration part.

In some embodiment, the first layer and the third layer are made of aluminium foils.

In some embodiment, the second layer is made of foamed plastic.

In some embodiment, the through holes are formed in the body via a laser perforation process.

In some embodiment, diameters of the through holes are in a range from 10 um to 1000 um.

In some embodiment, distances between adjacent two of the through holes are in a range from 0.1 mm to 0.5 mm.

In some embodiment, a depth of the first layer is equal to that of the third layer.

In some embodiment, a depth of the second layer is 3~5 times of that of the first layer.

In some embodiment, a shape of the first layer of the dome conforms to that of the vibration part.

Compared with the related art, the dome of the speaker of the present disclosure comprises the first layer, the second layer and the third layer which are stacked in a direction from the coil to the diaphragm. The second layer has a honeycomb structure. The third layer comprises a body and a plurality of through holes extending through the body in the vibration direction. The through holes and the honeycomb structure cooperatively form the resonance cavity. When the frequency of the incident sound wave is equal to the natural frequency of the vibration unit, the air columns formed in the through holes generate violent motion due to resonance, thereby consuming sound energy by overcoming the frictional resistance of the inner surfaces of the through holes. The sensitivity and sound distortion in the vicinity of the resonance frequency is reduced, and the effect of amplifying the noise by the peak of the resonance frequency is minimized. By adjusting the data of each characteristic of the through holes and thereby adjusting the frequency range of sound absorption of the resonance cavity, the purpose of optimizing the acoustic performance and playback effect of the speaker can be achieved.

BRIEF DESCRIPTION OF THE DRAWINGS

In order to explain the technical solutions of the embodiments of the present disclosure more clearly, accompanying drawings used to describe the embodiments are briefly introduced below. It is evident that the drawings in the following description are only concerned with some embodiments of the present disclosure. For those skilled in the art, in a case where no inventive effort is made, other drawings may be obtained based on these drawings.

DESCRIPTION OF THE EMBODIMENTS

The technical solutions in embodiments of the present disclosure will be clearly and completely described with reference to the accompanying drawings of the present disclosure. It is evident that the elements described are only some rather than all embodiments of the present disclosure. Based on the embodiments of the present disclosure, all other embodiments obtained by those skilled in the art without making any inventive effort fall into the protection scope of the present disclosure.

Figure 1:
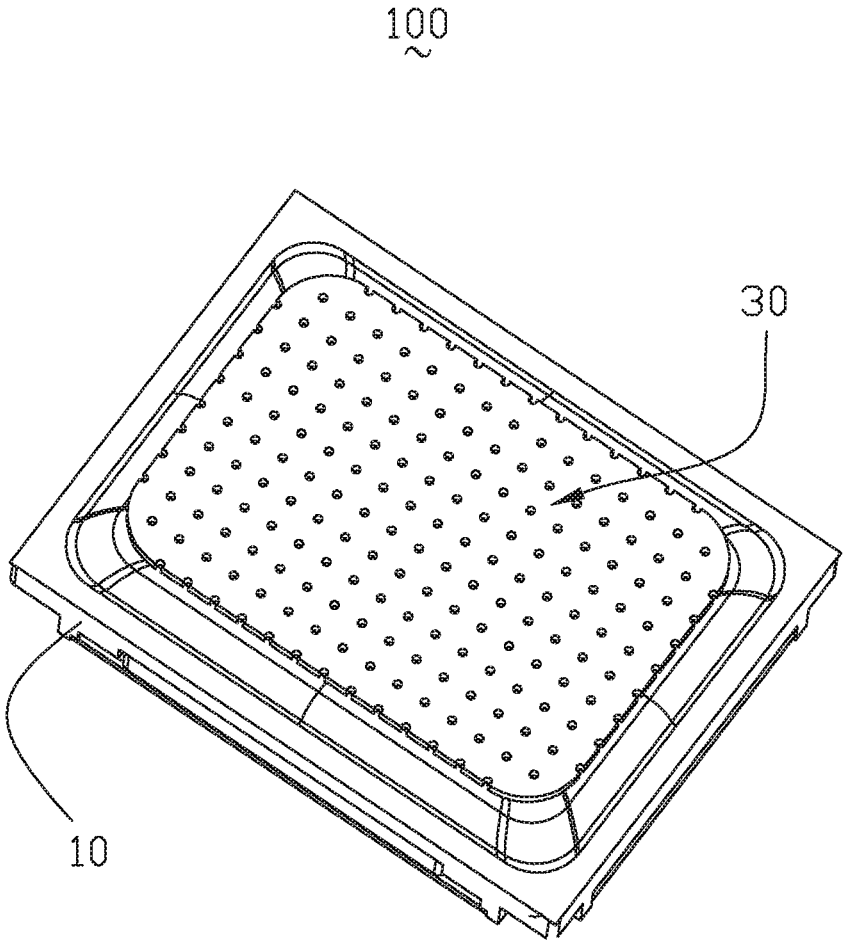
FIG. 1 is a schematic view of a speaker in accordance with an exemplary embodiment of the present disclosure.
Figure 2:
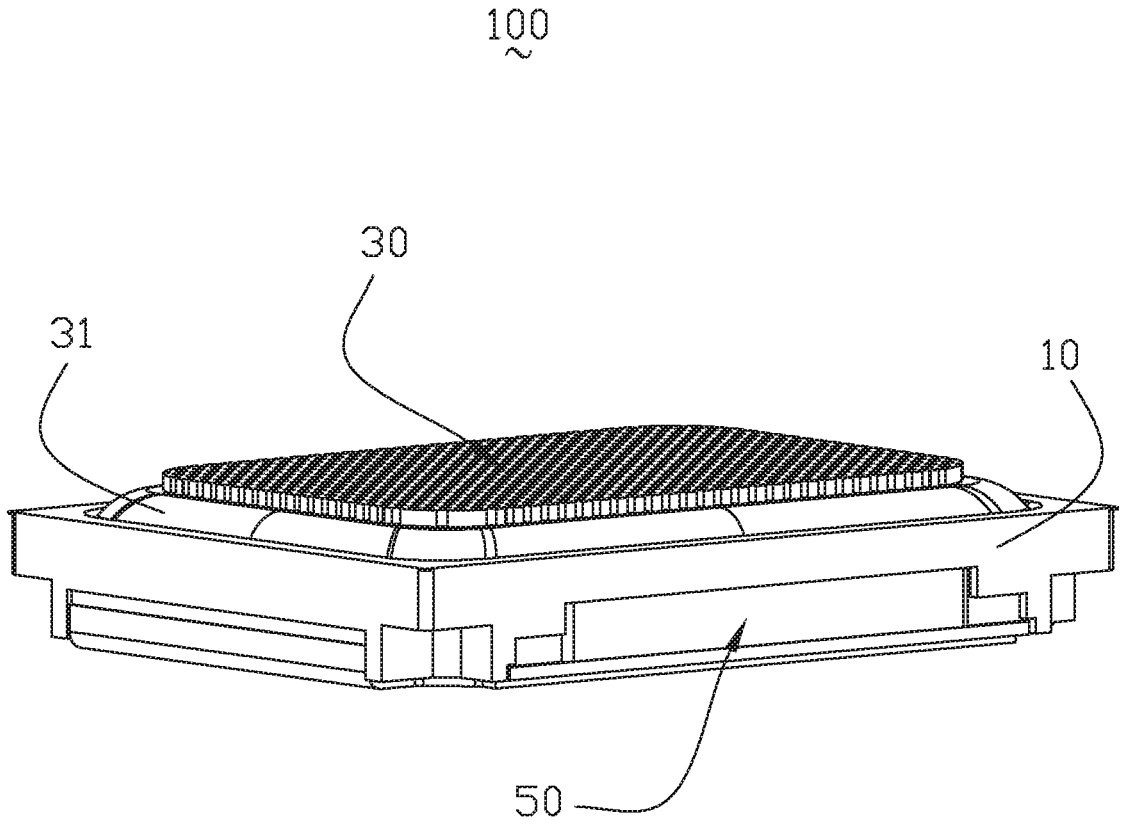
FIG. 2 illustrates the speaker of FIG. 1, viewed from another aspect.
Figure 3:
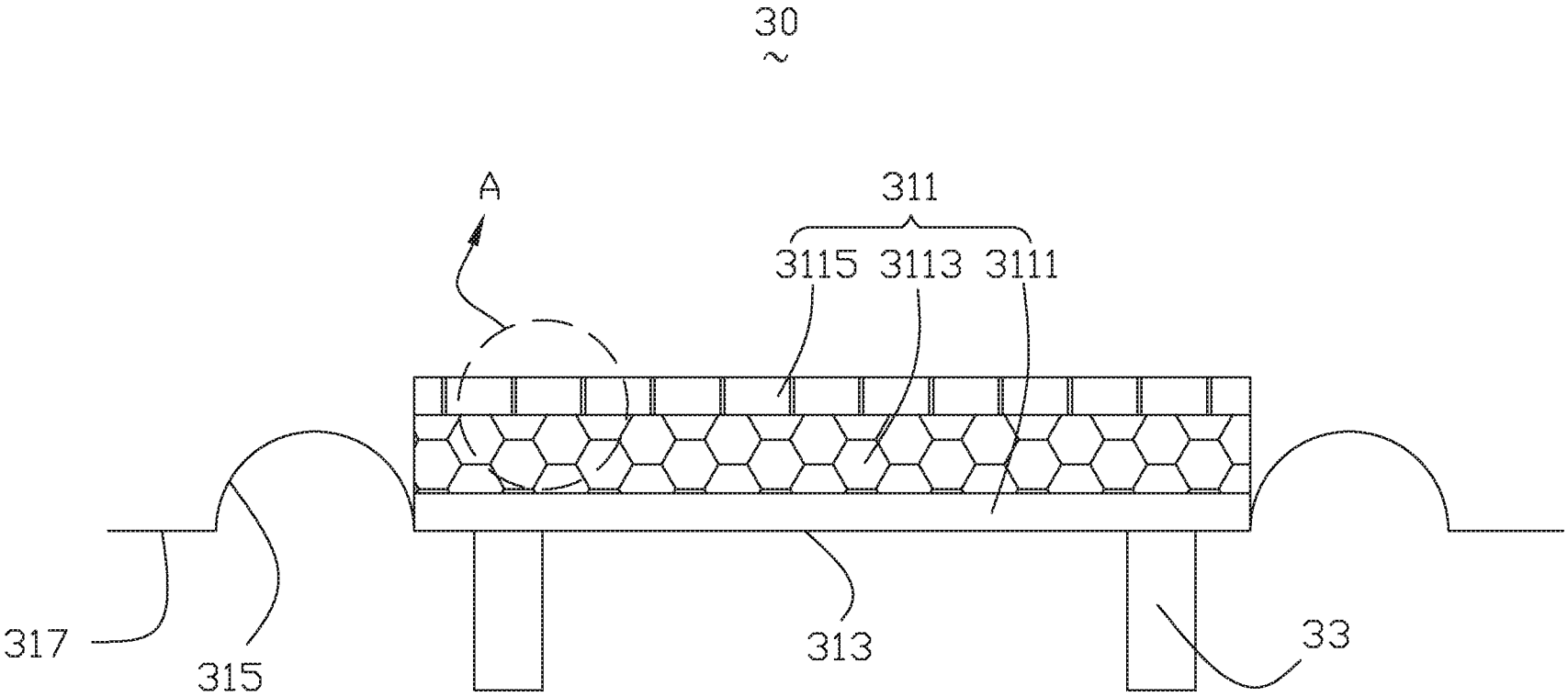
FIG. 3 is a schematic view of a vibration unit of the speaker of FIG. 1.
Figure 4:
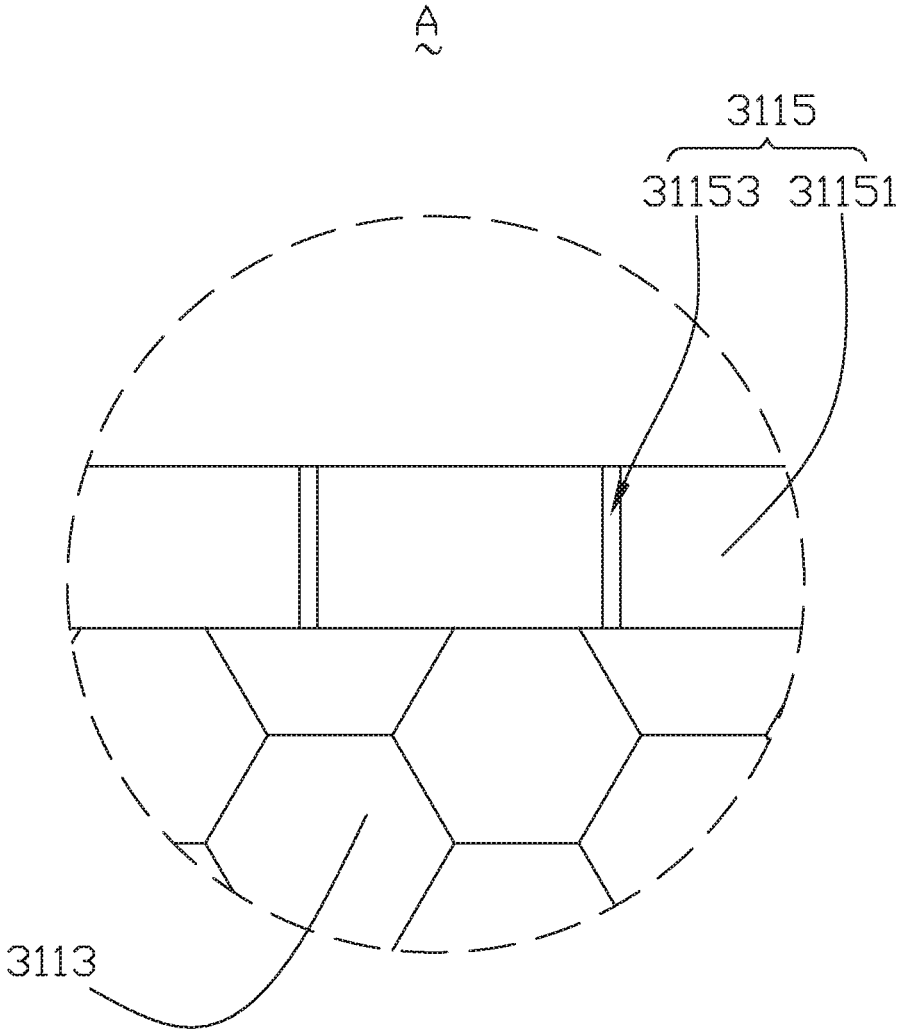
FIG. 4 is an enlarged view of the encircled part A of FIG. 3.

Referring to FIG. 1 to FIG. 4, a speaker 100 in accordance with an exemplary embodiment of the present disclosure comprises a frame 10, a vibration unit 30 and a magnetic circuit unit 50.

The vibration unit 30 comprises a diaphragm 31 fixed to the frame 10, and a coil 33 configured to drive the diaphragm 31 to vibrate and sound. The magnetic circuit unit 50 comprises permanent magnets (not shown) configured to interact with the coil 33 when the coil 33 is energized to thereby drive the coil 33 and the diaphragm 31 to reciprocate in the vibration direction.

The diaphragm 31 comprises a dome 311, a vibration part 313 connected to the dome 311, a suspension part 315 extending outwardly from the vibration part 313 and a mounting part 317 extending outwardly from the suspension part 315. The mounting part 317 is fixedly connected to the frame 10 to thereby fix the diaphragm 31 to the frame 10.

The dome 311 comprises a first layer 3111, a second layer 3113 and a third layer 3115. In this embodiment, the first layer 3111 and the third layer 3115 are made of aluminium foils. The second layer 3113 is made of foamed plastics. The first layer 3111, the second layer 3113 and the third layer 3115 are stacked sequentially in a direction from the coil 33 to the diaphragm 31.

The dome 311 is fixed to the vibration part 313. Specifically, the shape of the first layer 3111 of the dome 311 conforms to the shape of the vibration part 313. The first layer 3111 of the dome 311 in contact with the vibration part 313 is fixed to the vibration part 313.

The second layer 3113 has a honeycomb structure. In some embodiment, the depth of the first layer 311 in the vibration direction of the diaphragm is equal to that of the third layer 3115, and the depth of the second layer 3113 in the vibration direction is 3~5 times of that of the first layer 311. In this embodiment, the depth of the second layer 3113 is three times of that of the first layer 311.

The third layer 3115 comprises a body 31151 and a plurality of through holes 31153 passing through the body 31151 in the vibration direction. The through holes 31153 communicate with the honey structure of the second layer 3113 to form a resonance cavity. In the resonance cavity, the through holes 31153 are configured to provide acoustic mass and the honeycomb structure is configured to provide acoustic compliance.

Preferably, the through holes 31153 are formed in the body 31151 via a laser perforation process.

In this embodiment, the diameter of the through holes 31153 is in the range from 10 um to 1000 um. The distance between adjacent through holes 31153 is in the range from 0.1 mm to 0.5 mm. Understandably, in other embodiments, the diameter, distribution, open rate and other characteristics of the through holes 31153 can be adjusted according to design requirement. By adjusting the data of each characteristic of the through holes 31153 and thereby adjusting the frequency range of sound absorption of the resonance cavity, the purpose of optimizing the acoustic performance and playback effect of the speaker 100 can be achieved.

Compared with the speakers of the related art, the dome of the speaker of the present disclosure comprises the first layer, the second layer and the third layer which are stacked in a direction from the coil to the diaphragm. The second layer has a honeycomb structure. The third layer comprises a body and a plurality of through holes extending through the body in the vibration direction. The through holes and the honeycomb structure cooperatively form the resonance cavity. When the frequency of the incident sound wave is equal to the natural frequency of the vibration unit, the air columns formed in the through holes generate violent motion due to resonance, thereby consuming sound energy by overcoming the frictional resistance of the inner surfaces of the through holes. The sensitivity and sound distortion in the vicinity of the resonance frequency is reduced, and the effect of amplifying the noise by the peak of the resonance frequency is minimized. By adjusting the data of each characteristic of the through holes 31153 and thereby adjusting the frequency range of sound absorption of the resonance cavity, the purpose of optimizing the acoustic performance and playback effect of the speaker 100 can be achieved.

The above shows and describes the embodiments of the present disclosure. It is understandable that the embodiments above are only exemplary, and should not be interpreted as limiting the present disclosure, and those skilled in the art can make changes, modifications, replacements and deformations to the embodiments above within the scope of the present disclosure.

What is claimed is:

1. A speaker comprising:

a frame;

a vibration unit fixed to the frame, the vibration unit comprising a diaphragm fixed to the frame, and a coil configured to drive the diaphragm to vibrate and sound, the diaphragm comprising a dome; and a magnetic circuit unit fixed to the frame;

wherein the dome comprises a first layer, a second layer and a third layer which are stacked sequentially in a direction from the coil to the diaphragm;

the second layer comprises a honeycomb structure; and the third layer comprises a body and a plurality of through holes extending through the body in a vibration direction of the diaphragm, the through holes communicating with the honeycomb structure of the second layer to form a resonance cavity, diameters of the through holes are in a range from 10 um to 1000 um.

2. The speaker of claim 1, wherein the diaphragm further comprises a vibration part connected to the dome, a suspension part extending outwardly from the vibration part and a mounting part extending outwardly from the suspension part, the dome being fixed to the vibration part, the mounting part being fixed to the frame.

3. The speaker of claim 1 wherein the first layer and the third layer are made of aluminium foils.

4. The speaker of claim 1, wherein the second layer is made of foamed plastic.

5. The speaker of claim 1, wherein the through holes are formed in the body via a laser perforation process.

6. The speaker of claim 1, wherein distances between adjacent two of the through holes are in a range from 0.1 mm to 0.5 mm.

7. The speaker of claim 3, wherein a depth of the first layer is equal to that of the third layer.

8. The speaker of claim 1, wherein a depth of the second layer is 3~5 times of that of the first layer.

9. The speaker of claim 2, wherein a shape of the first layer of the dome conforms to that of the vibration part.

* * * * *